US005800238A

United States Patent [19]

Cowley et al.

[11] Patent Number: 5,800,238

[45] Date of Patent: Sep. 1, 1998

[54] BOOK WITH MOVABLE TOY FOR CHILDREN

[75] Inventors: David Stewart Cowley, Berks, United Kingdom; Michael J. Morris, Weston, Conn.

[73] Assignee: Joshua Morris Publishing, Inc., Westport, Conn.

[21] Appl. No.: 723,730

[22] Filed: Sep. 30, 1996

[51] Int. Cl.[6] ..... A63H 3/00; A63H 33/38; B42D 1/00

[52] U.S. Cl. ..... 446/72; 446/147; 281/15.1

[58] Field of Search ..... 446/72, 73, 148, 446/149, 151, 152, 147; 281/15.1, 51

[56] References Cited

U.S. PATENT DOCUMENTS

| | | | |
|---|---|---|---|
| 2,367,373 | 1/1945 | Ralston | 446/151 |
| 2,740,231 | 4/1956 | Baller | 446/151 |
| 3,981,180 | 9/1976 | Chamberlin | 446/151 |
| 4,819,963 | 4/1989 | Wolski | 281/15.1 |
| 4,828,289 | 5/1989 | Korner | 281/15.1 |

*Primary Examiner*—Robert A. Hafer
*Assistant Examiner*—Laura Fossum
*Attorney, Agent, or Firm*—Kenyon & Kenyon

[57] ABSTRACT

A book wherein one or more of the covers or pages or binding is provided with a track, and a toy figure is movably coupled to the track. For this purpose, the cover(s) or page(s) which attach the toy figure have sufficient structural integrity to support the toy figure and the movement of the toy figure along the track. Preferably, the track is provided along the edge or periphery of a cover or page so that the toy figure may be moved around the periphery of the book even when the book is closed. The toy figure preferably takes the shape of an animal or other creature which is the subject of a story in the book. In this way, a young reader can easily correlate the movable toy figure with the story. The book is particularly useful in encouraging children to read.

11 Claims, 3 Drawing Sheets

BOOK WITH MOVABLE TOY FOR CHILDREN

BACKGROUND OF THE INVENTION

1. Field of the Invention

The invention relates to the field of children's books in general, and more particularly to children's story books.

2. Description of Related Art

As a way of inducing children to learn to read, persons have created stories about creatures engaged in human endeavors. For example, stories about animals, insects, and even plant life have been created wherein these creatures speak and behave like humans and wherein they engage in human-like activities. Stories of this nature have been found to attract the interest of children, thereby encouraging them to read more often.

In addition to the subject matter of the story, it has been found that illustrations play an important role in attracting a child's interest. Hence, children's story books have been provided with large, colorful pictures illustrating the subject matter or the background thereof.

The prior art has been somewhat successful in creating books which teach children to read. For example, U.S. Pat. 4,819,963 teaches a book which is sculptured in the shape of a fish or other form, apparently for the purpose of gaining the interest of children. However, it would be desirable to further attract the interest of children in order to even better encourage their learning to read.

SUMMARY OF THE INVENTION

Accordingly, it is an object of the invention to provide a children's book having features which attract the attention and interest of young children.

It is a further object of the invention to provide a children's book having a toy which is movable along the book.

It is a further object of the invention to provide such a book wherein the toy is slidably mounted on the book to permit the reader to slide the toy around the periphery of the book.

It is yet a further object of the invention to provide such a book wherein the toy takes the form of a creature (eg., animal, Fish, insect or plant life) which is the subject of the story of the book.

These and other objects of the invention which will become apparent from the following detailed description are achieved as follows. The invention is a book having a front cover, a back cover, and a multiplicity of pages therebetween, all of which are bound along one side. One or more of the covers or pages is provided with a track, such as a channel, for slidably attaching a toy figure. For this purpose, the cover(s) or page(s) which attach the toy figure have sufficient structural integrity to support the toy figure and the movement of the toy figure along the track. For example, the cover which supports the toy figure may be thicker or comprised of a harder material than the other pages of the book. Preferably, the slide track is defined along the edge/periphery of a cover or page so that the toy figure may be moved around the periphery even when the book is closed. The toy figure preferably takes the shape of an animal or other creature which is the subject of the story in the book. In this way, the young reader can easily correlate the movable toy figure with the story. Multiple toy figures may also be provided.

DETAILED DESCRIPTION OF THE INVENTION

Figure 1:
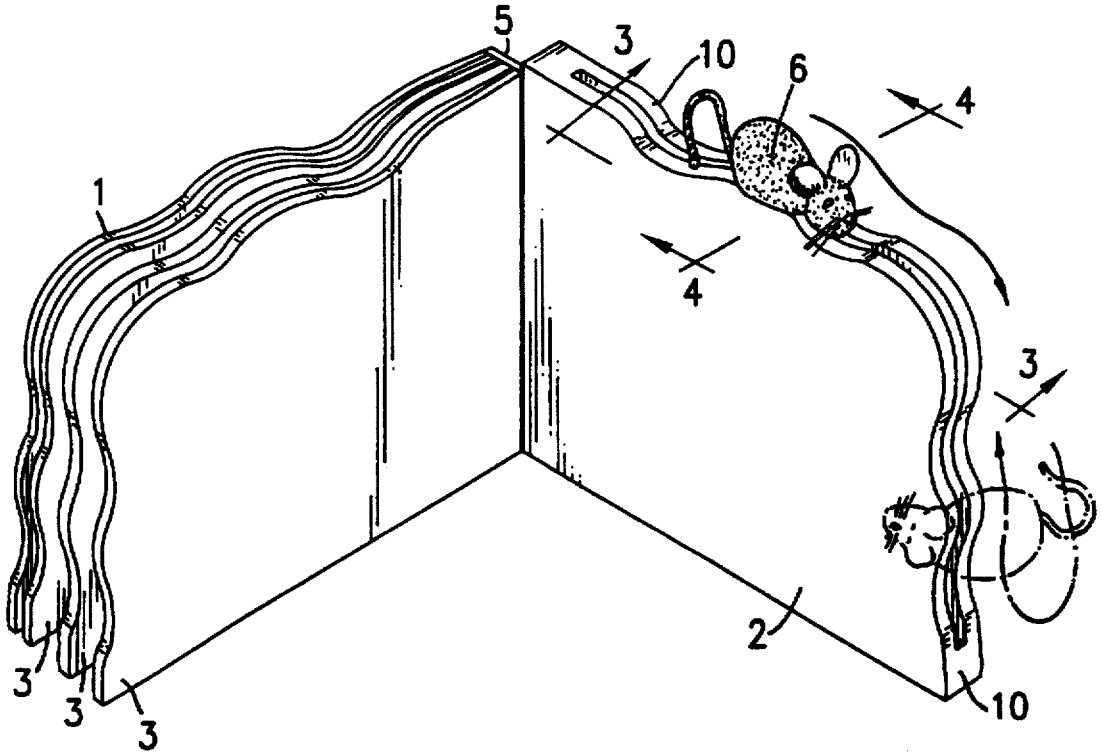
FIG. 1 is a perspective view of a book in accordance with the invention wherein the book is in an open position.

Referring to FIG. 1, a perspective view of a book in accordance with a preferred embodiment of the invention is illustrated. The book includes a front cover 1, a back cover 2, and a multiplicity of pages 3. The covers 1 and 2 and the pages 3 are bound along one common side thereof by a binding 5 in a conventional and well known manner. The binding 5 can be any conventional binding such as glue, staples, rings, etc. Of course, binding 5 permits the covers and the pages to be turned as in any conventional book. Preferably, the covers 1, 2 and the pages 3 are made of a cardboard to lend structural integrity to the book. Since cardboard is resistant to tearing, the provision of cardboard covers and pages will render the book sturdy and tear-resistant, and hence particularly suitable for the young children.

The covers 1, 2 and the pages 3 include a written story and/or illustrations thereon of interest to children. For example, a story pertaining to the activities of a creature (e.g., animal, insect, fish, plant life, etc . . . ) together with colorful illustrations is particularly suitable for attracting the interest of young children.

One or more of the pages 3 or covers 1, 2 or binding 5 attaches a toy FIG. 6 for movement thereon. For this purpose, one or more of the pages 3 or covers 1, 2 is provided with a track, for example a channel 7, for permitting sliding or rolling movement of the toy figure along the book. Of course, many other track designs besides a channel are known from the toy art. These other track designs may be used in place of channel 7, and are within the scope of the invention when used in combination with a book. For example, channel 7 may be replaced by a rail or a pair of rails.

The toy FIG. 6 includes a prong 8 for guiding the toy figure in the channel 7. The prong 8 includes a head 9 which is sized so as to be able to slide within the channel 7. The region of prong 8 opposite the head 9 may be threaded 11 (see threads 11 illustrated in phantom in FIG. 3) as in a screw for permanently coupling the prong 8 to the toy FIG. 6. For this purpose, the toy FIG. 6 may include a wood base for permitting the prong 8 to be screwed into it. The prong 8 may also be formed from a plastic molding material which is shaped to provide a suitable fixing and coupling member, for both fixing to the toy FIG. 6 and for coupling of the toy figure into the channel 7. This plastic member can be formed from one or more parts. If formed from more than one part, the plastic member may be designed to incorporate a sliding sleeve or spring mechanism (not illustrated) to allow the toy FIG. 6 to move across a sharper curve than the size of the toy would otherwise permit.

Preferably, channel 7 is defined along the edge or periphery 10 of either a cover 1 or 2 or a page 3. For this reason, it will be appreciated that the pages or covers to which a toy figure will be attached should be thick enough to define a wide enough edge 10 to support the channel 7. In the preferred embodiment illustrated in FIGS. 1–4, the channel 7 is defined in the periphery 10 of the back cover 2.

Figure 2:
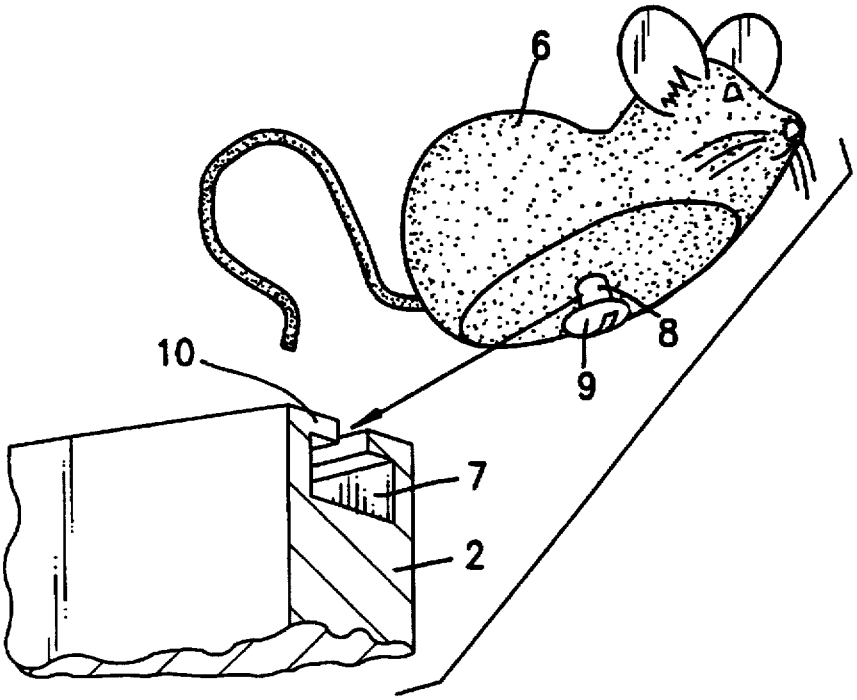
FIG. 2 is an exploded, isolated view of the toy figure and slide channel of the book of FIG. 1.
Figure 4:
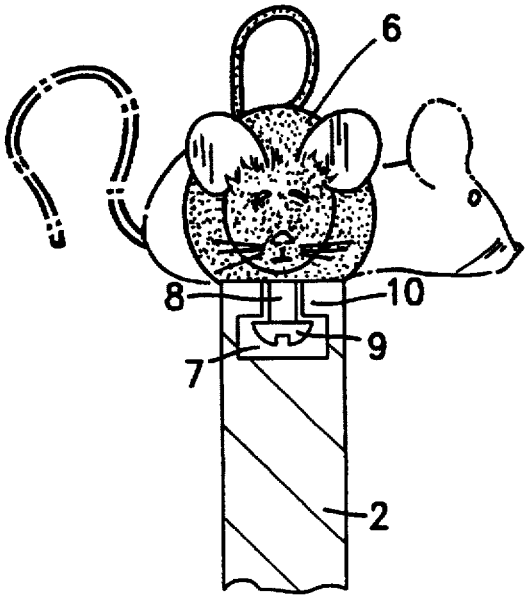
FIG. 4 is an isolated, cross-sectional view of the toy figure coupled to the slide channel around the periphery of the book of FIG. 1 taken along the line 4—4.

The channel 7 is wider beneath the edge 10 than on the surface of the edge 10 as illustrated in FIGS. 2 and 4. This will enable the head 9 of the prong 8 to slide freely beneath the edge 10 as the toy FIG. 6 is moved along the track. However, the smaller width of the channel 7 on the surface of the edge 10 itself retains the head 9 underneath the edge 10. The edge 10 may be constructed of a flexible plastic to facilitate forcing of the head 9 beneath it during assembly of the book. During assembly, the head 9 may be angled into the channel 7 and then snap-forced beneath the edge 10.

It will be apparent to those skilled in the art that coupling members having configurations other than the specific configuration of prong 8 may be used to movably couple the toy 6 to the channel 7. For example, where a different track is used in place of channel 7, such as a rail or a pair of rails, a different coupling member would be used on the toy FIG. 6. In the case of a rail or a pair of rails being used as the track, a wheel or pair of wheels on an axle would replace the prong 8 on the toy 6 in order to movably couple the toy to the rail(s) on the edge 10 of the book cover 2. These other coupling members are within the scope of the invention when used in combination with a book.

Figure 3:
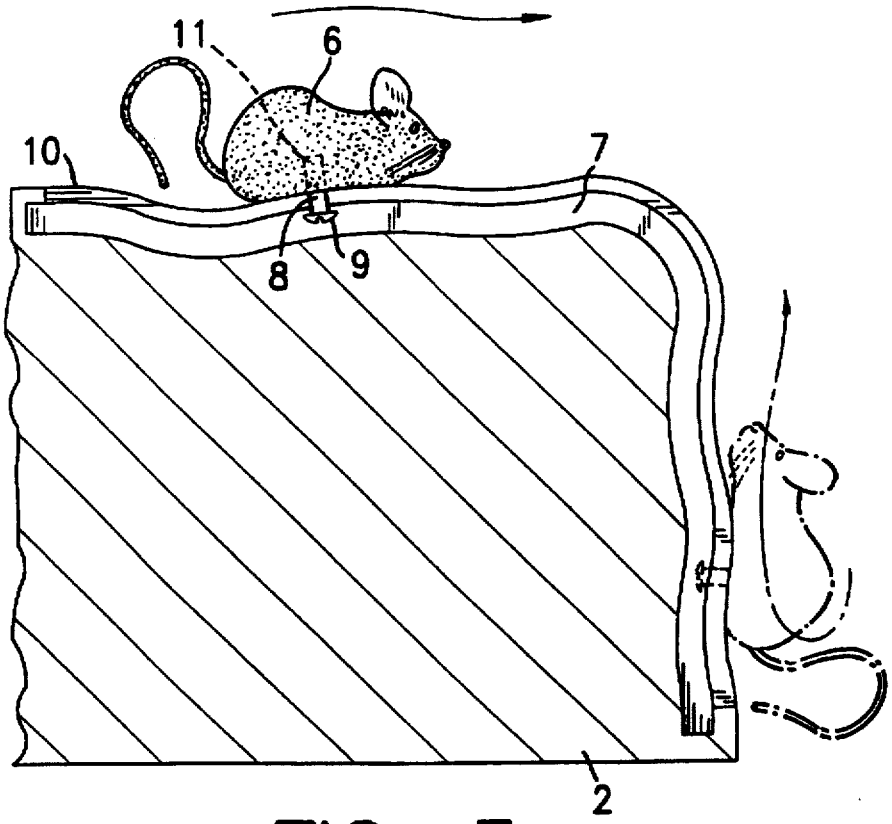
FIG. 3 is a cross-sectional view of the book of FIG. 1 taken along the line 3—3.

As illustrated in FIGS. 1 and 3, it is possible to slide the toy FIG. 6 along the channel 7 by simply pushing it along the periphery 10. When the toy FIG. 6 has reached the end of the channel 7, as illustrated in phantom in FIGS. 1 and 3, the toy 6 can be simply rotated 180° and then pushed in the opposite direction toward the other end of the slide track. The rotation of the toy FIG. 6 is illustrated in phantom in FIGS. 1 and 4. It will be appreciated that rotation is possible because of the configuration of the prong 8, wherein the head 9 is situated beneath the edge area 10 of the book cover 2.

The periphery/edge 10 of the cover 2 to which the toy FIG. 6 is attached may be contoured like a wave, as illustrated in FIGS. 1 and 3, so that the toy FIG. 6 will exhibit wave-like movement as it is pushed along the slide channel 7 (see FIGS. 1 and 3). This can, for example, simulate the scampering movement of a mouse.

In a preferred embodiment of the invention, the toy FIG. 6 is in the shape of a creature which is the subject of the story of the book. In the case of FIGS. 1–4, the toy FIG. 6 is in the form of a mouse, and the story would preferably be about a mouse. However, it will be appreciated that other creatures or even objects may be chosen for the toy FIG. 6, such as automobiles, trucks, sleds, fish, or even plant life. Young children who are learning to read will easily correlate the toy figure with the subject of the story. In addition, the presence of the slidable toy figure will attract the attention, and hopefully the interest, of young children learning to read.

Figure 5:
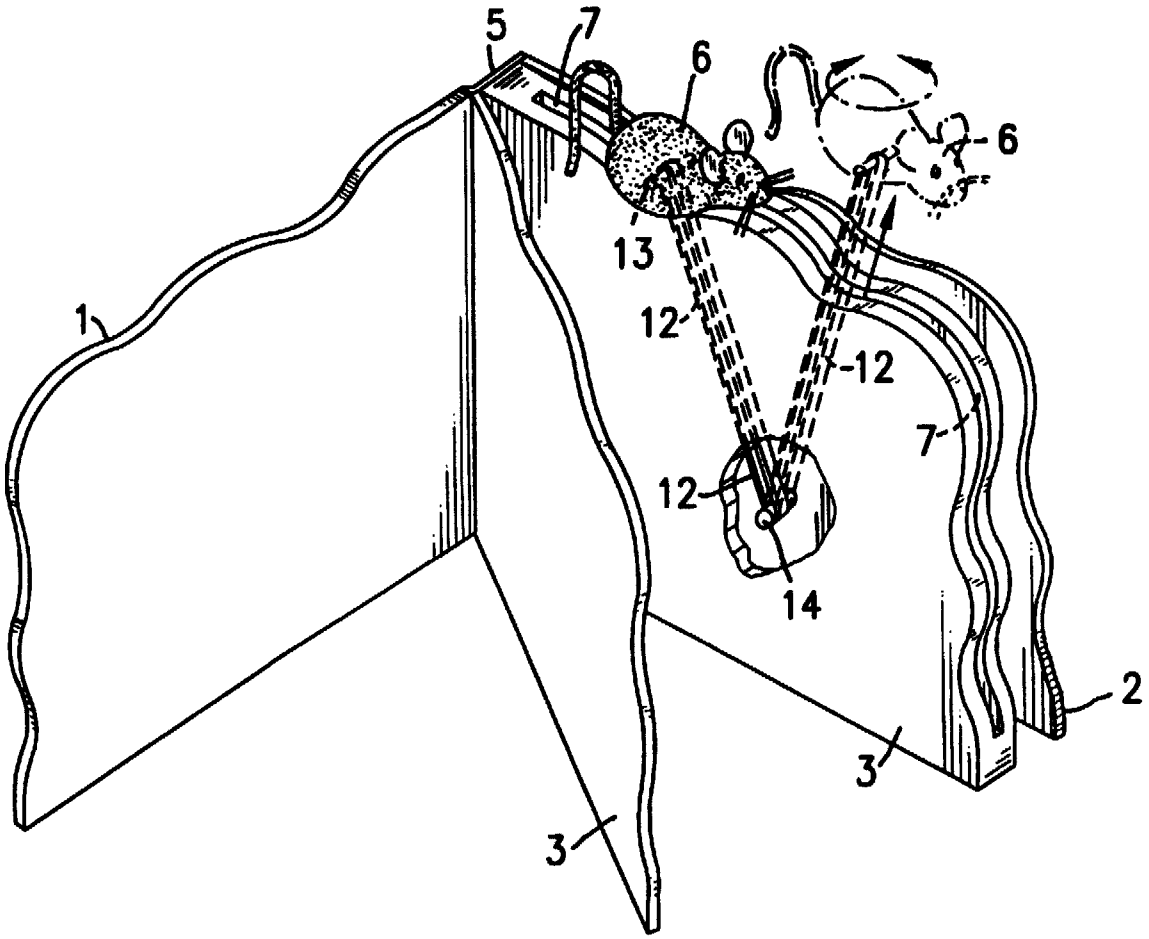
FIG. 5 is a perspective view of a book in accordance with another embodiment of the invention.

Another embodiment of the invention is illustrated in FIG. 5, where reference numerals which correspond to those used in FIGS. 1–4 depict like elements. In the embodiment of FIG. 5, prong 8 is replaced with elastic band 12. The elastic band 12 is fixedly coupled to the toy FIG. 6 by a fixing peg 13, which is illustrated in phantom in FIG. 5. Fixing peg 13 functions as an anchor in the toy FIG. 6, for fixing the elastic band 12 to the toy figure.

The elastic band 12 extends from the fixing peg 13 down into the channel 7, as illustrated in phantom in FIG. 5, until the elastic band reaches a fixed peg 14 which is anchored in the channel 7. Preferably, the fixed peg 14 is positioned near the central region of the cover 1 or 2 or page 3 which contains the channel 7. For this purpose, it will be appreciated that channel 7 will be much deeper than the channel 7 which is required in the embodiment of FIGS. 1–4. The fixed peg 14 serves as a fixed axis around which the elastic band (which is also coupled to the toy figure) can rotate, like the hand of a clock.

The average radial distance between the fixed peg 14 and the peripheral edge 10 of the book should be slightly longer than the length of the elastic band. In this way, the elastic band will always or usually be slightly tensioned to urge the toy FIG. 6 toward the peripheral edge 10 so that the toy FIG. 6 is against the edge 10. As the toy FIG. 6 is pushed along the edge 10, the tension supplied by the elastic band 12 will force the toy figure to ride along the contour of the edge 10. As the toy FIG. 6 is pushed along the edge 10, the elastic band 12 will rotate around the fixed peg 14, like the hand of a clock.

Of course, in this embodiment the toy FIG. 6 may be rotated 180° to push it in the opposite direction along channel 7. Rotation of the toy FIG. 6 is permitted by the elasticity of the band 13.

In the foregoing specification, the invention has been described with reference to specific exemplary embodiments thereof. It will, however, be evident that various modifications and changes may be made there unto without departing from the broader spirit and scope of the invention as set forth in the appended claims. The specification and drawings are accordingly to be regarded in an illustrative rather than a restrictive sense.

What is claimed is:

1. A book in combination with a toy figure, comprising:

a front cover, a back cover, and a multiplicity of pages therebetween, said front cover, back cover and pages being bound along one side thereof by a binding;

at least one of said front cover, back cover, binding or pages having a track disposed along a peripheral edge thereof; and a toy figure coupled to said track and being slidable along said track, said toy figure projecting outsides the book, when the book is in either an open position or a closed position wherein said toy figure is rotatable about a predetermined axis, the predetermined axis being parallel to a Plane of at least one of said front cover, said back cover, and said multiplicity of pages.

2. The book according to claim 1, wherein the toy figure is slidably coupled to the track by a prong which is attached to the toy figure, the prong having a head which is adapted to be slidably received in the track.

3. The book according to claim 2, wherein the head of the prong is situated beneath a surface of the peripheral edge in which the track is defined.

4. The book according to claim 1, wherein the toy figure is rotatably coupled to the track.

5. The book according to claim 1, wherein the peripheral edge on which the track is disposed has a wave contour.

6. The book according to claim 1, wherein the peripheral edge in which the channel is defined has a wave contour.

7. The book according to claim 1, wherein the toy figure has the shape of a living creature.

8. The book according to claim 7 wherein the pages describe and illustrate a story concerning said living creature.

9. The book according to claim 1, wherein the toy figure has the shape of a vehicle.

10. The book according to claim 1, wherein the toy figure is coupled to the track by an elastic band.

11. The book according to claim 10 wherein the elastic band has a first end which is fixedly coupled to the toy figure and a second end which is fixedly coupled to a peg inside the track.

* * * * *